US008298022B2

(12) United States Patent
Tsuruta et al.

(10) Patent No.: US 8,298,022 B2
(45) Date of Patent: Oct. 30, 2012

(54) MALE CONNECTOR AND CONNECTOR APPARATUS

(75) Inventors: Satoshi Tsuruta, Yokkaichi (JP); Takeshi Ishibashi, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 106 days.

(21) Appl. No.: 12/861,192

(22) Filed: Aug. 23, 2010

(65) Prior Publication Data

US 2011/0053404 A1 Mar. 3, 2011

(30) Foreign Application Priority Data

Aug. 26, 2009 (JP) ..... 2009-195528

(51) Int. Cl.
*H01R 9/24* (2006.01)

(52) U.S. Cl. ..... 439/886; 439/948

(58) Field of Classification Search ..... 439/886, 439/871, 134, 521, 36, 933, 948, 595, 660
See application file for complete search history.

(56) References Cited

U.S. PATENT DOCUMENTS 5,455,515 A * 10/1995 Saijo et al. ..... 324/538
5,743,761 A * 4/1998 Kawase ..... 439/595
6,918,800 B2 * 7/2005 Ota et al. ..... 439/886
7,674,137 B2 * 3/2010 Sato ..... 439/693
2008/0261420 A1 * 10/2008 Riddle ..... 439/134

FOREIGN PATENT DOCUMENTS

JP 2002-056919 2/2002

* cited by examiner

*Primary Examiner* — Tulsidas C Patel
*Assistant Examiner* — Travis Chambers
(74) *Attorney, Agent, or Firm* — Gerald E. Hespos; Michael J. Porco

(57) ABSTRACT

A male connector (10) has a male terminal fitting (20) mounted in a male housing (10A). The male housing (10A) has tube (11) surrounding the male terminal fitting (20). The tube (11) is spaced out from a conductive part (23) of the male terminal fitting (20) by a distance so that a finger cannot be inserted between the tube (11) and the male terminal fitting (20). A fit-on part (31) of a female connector (30) can be inserted between the tube (11) and the male terminal fitting (20) so that a female terminal fitting (34) can contact the conductive part (23) of the male terminal fitting (20). An insulating coating (26) is formed on a front end of the male terminal fitting (20) by molding a resin to prevent shocks.

9 Claims, 7 Drawing Sheets

MALE CONNECTOR AND CONNECTOR APPARATUS

BACKGROUND OF THE INVENTION

1. Field of the Invention

The invention relates to a male connector having an electrical shock prevention measure and a connector apparatus.

2. Description of the Related Art

A known connector apparatus for supplying electric power to equipment mounted on an electric car has male and female connectors that can be connected to one another. The male connector is mounted on a case for the equipment and the female connector is connected to electric wires of a wire harness. The equipment-side male connector has two male terminal fittings is mounted in a housing. The housing has a tube that surrounds the periphery of the male terminal fittings. The front of the tube is open to receive a fit-on part of the electric wire-side female connector. Thus, the male terminal fittings of the equipment-side male connector are exposed to the outside when the male and female connectors are separated for maintenance.

An electric circuit for power is accommodated inside the equipment mounted on the electric car. In dependence on an operational state of the electric circuit, the male terminal fitting is in a charged state. Thus when the female connector is removed from the male connector, there is a fear that an operator carelessly touches the male terminal fitting and receives an electrical shock.

JP 2002-56919 proposes a connector to cope with the above-described problem. The connector of JP 2002-56919 has a prevention rib that projects from the inner surface of the tube that surrounds the male terminal fitting. The prevention rib is intended to prevent a finger from entering the gap between the tube and the male terminal fitting. However, the connector of JP 2002-56919 also must have a groove on the peripheral surface of the fit-on part of the mating connector to avoid interference between the fit-on part and the prevention rib. Consequently the fit-on part has a complicated construction or the connector is large due to a spatial restriction. The conventional construction shown in FIGS. 8 and 9 of JP 2002-56919 also has an insulator made of resin mounted on the front end of the male terminal fitting. The insulator may be removed from the front end of the connector when foreign matter strikes the insulator strongly. Thus the construction is unreliable.

The invention has been made in view of the above-described situation. It is an object of the invention to provide a compact male connector and connector apparatus that can prevent a finger of an operator from contacting a male terminal fitting for reliably preventing the finger from receiving an electrical shock.

SUMMARY OF THE INVENTION

The invention relates to a male connector with a male terminal fitting mounted in a housing. The housing has a tube that surrounds projecting parts of the male terminal fitting. The tube is spaced out from a conductive part of the male terminal fitting to define a fit-on space. The fit-in space is too small to receive a finger, but can receive a fit-on part of a female connector and a female terminal fitting mounted in the fit-on part. An insulating coating is formed on a front end of the male terminal fitting by molding a resin. Thus, a finger cannot contact the conductive part of the male terminal fitting and an operator cannot receive a shock when the connectors are separated.

The insulating coating on the front end of the male terminal fitting is formed by molding the resin, and hence is held on the male terminal fitting at a much higher strength as compared with a conventional construction in which the insulator is attached to the front end of the male terminal fitting. Thus, the insulation function is not likely to be damaged by foreign matter or an external force. Additionally, molding the resin to form the insulating coating part does not take much time or labor and facilitates quality management, as compared with an insulator mounted on the front end of the male terminal fitting.

The insulating coating part formed on the front end of the male terminal fitting eliminates the need for the housing to have a prevention rib projecting from the inner periphery of the tube to prevent a hand from contacting the terminal fitting. Therefore, the connector is simplified, smaller and less expensive.

A groove preferably is formed on the insulating coating part of the male terminal fitting at a position opposite the front end of the male terminal fitting. The front of the male terminal fitting covered with the insulator has a wide surface area because the front has an irregular configuration due to the groove. Therefore the creepage distance along the surface of the insulating coating part from the contact point between the male terminal fitting and the finger pressed into the tube to the end point of the shaft not coated with the insulating coating is allowed to be longer than the creepage distance in the construction where the front end of the male terminal fitting is flat. Thus, the insulating coating part having this construction prevents the finger from contacting the conductive part of the male terminal fitting.

A groove may be formed on a portion of the male terminal fitting covered with the insulating coating part. Accordingly, the effect to be obtained by molding the resin in a uniform thickness along the surface of the male terminal fitting is similar to the effect to be obtained by forming the groove and molding the insulating coating part.

The housing may have two tubes and a guide rib between the tubes. The guide rib may be inserted into a guide groove of the female connector. The guide rib between the tubes prevents the finger from entering into the fit-on space and contacting the conductive part of the male terminal fitting. Further, the guide rib and the guide groove ensure that the male and female connectors are fit together in a correct orientation.

The invention also relates to a connector apparatus having the above-described male connector and a female connector to be fit on the male connector. The female connector has a fit-on part with a cavity and a female terminal fitting accommodated in the cavity. A lance is disposed in the fit-on part and locks the female terminal fitting in the cavity. The lance can deform elastically inside a flexibility allowance space to unlock the female terminal fitting. The guide rib of the male connector preferably penetrates into the flexibility allowance space of the female connector when the male and female connectors are fit together and prevents the lance from elastically deforming. Thus the female terminal fitting is locked doubly and can be held at a high strength.

The lance will be deformed and will project into the flexibility allowance space if the female terminal fitting is not inserted sufficiently into the cavity. Thus, the guide rib will contact the lance when the female and male connectors are being fit together and will prevent complete connection. Therefore, an operator immediately can detect that the female terminal fitting is in a locking-inadequate state. The guide rib on the male connector performs a guiding function when fitting the female and male connectors together. The guide rib is formed unitarily with the male housing and avoids an increase in the number of component parts while making the entire connector apparatus compact.

DETAILED DESCRIPTION OF THE PREFERRED EMBODIMENTS

A connector apparatus in accordance with the invention is illustrated in FIGS. 1 through 10 and is exemplified as a connector for supplying an electric power to equipment mounted on a car (for example, motor, inverter, and the like mounted on hybrid car). The connector apparatus has a male connector (see FIG. 2) 10 to be fixed to the equipment and a female connector 30 (see FIG. 5) that can be fit on the male connector 10. In the following description, the fit-on ends of the male and female connectors 10 and 30 are referred to as the front. The equipment has an unshown metal case to perform a shielding function and an unshown connector-mounting hole penetrates through the case.

Figure 1:
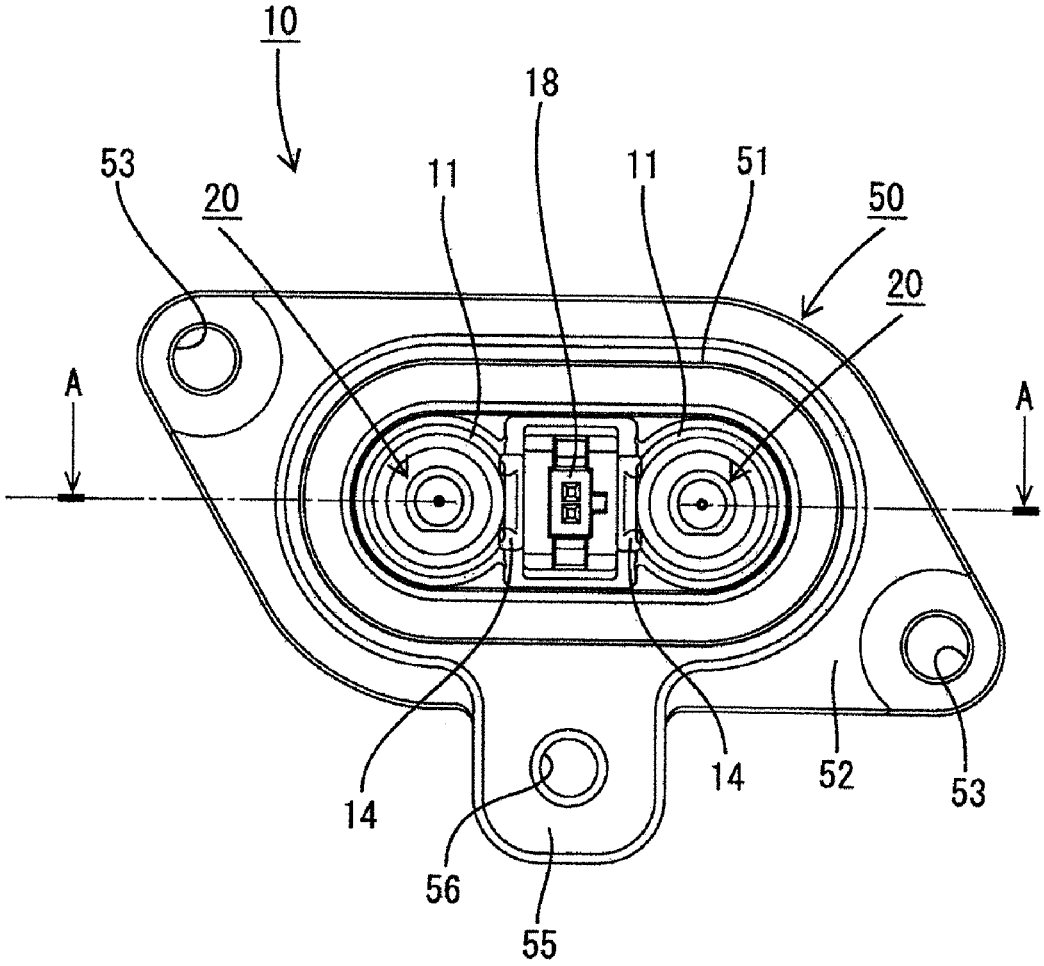
FIG. 1 is a top view of a male connector of an embodiment of the invention.
Figure 2:
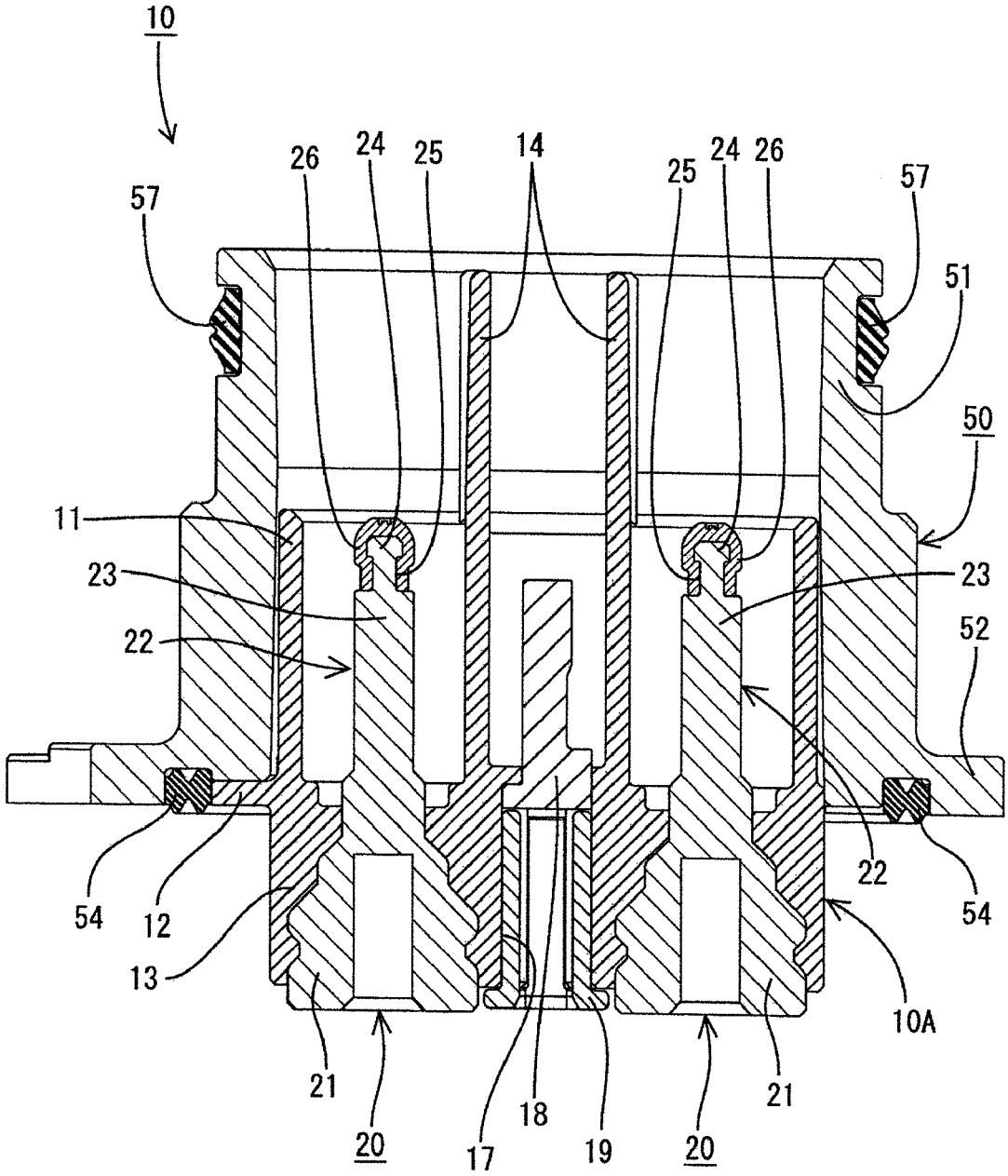
FIG. 2 is a sectional view taken along a line A-A.

The male connector 10 has a male housing 10A made of synthetic resin. Tubes 11 are formed in the male housing 10A, as shown in FIG. 2, and define fit-on spaces for receiving parts of the female connector 30 as described later. A plate-shaped flange 12 projects out from a rear end of the tubes 11 and an equipment-side connection part 13 projects rearward from a rear surface of the flange 12.

A male-side shielding shell 50 made of die-casted aluminum is mounted on the male housing 10A from the front. As shown in FIG. 2, the male-side shielding shell 50 covers the entire periphery of the tube 11 and is open at the front end. The male-side shielding shell 50 has a cylindrical body 51 and a mounting flange 52 projects outward from a rear end of the body 51 over the entire periphery thereof. Screw insertion holes 53 are formed at an upper left corner and a lower right corner in FIG. 1 for mounting the female connector 30 on the unshown case. A rubber packing 54 is provided on a front surface of the flange 12 of the male housing 10A, as shown in FIG. 2, and closely contacts an outer surface of the unshown case and seals the gap between a peripheral edge of the unshown connector-mounting hole and the male connector 10.

Figure 6:
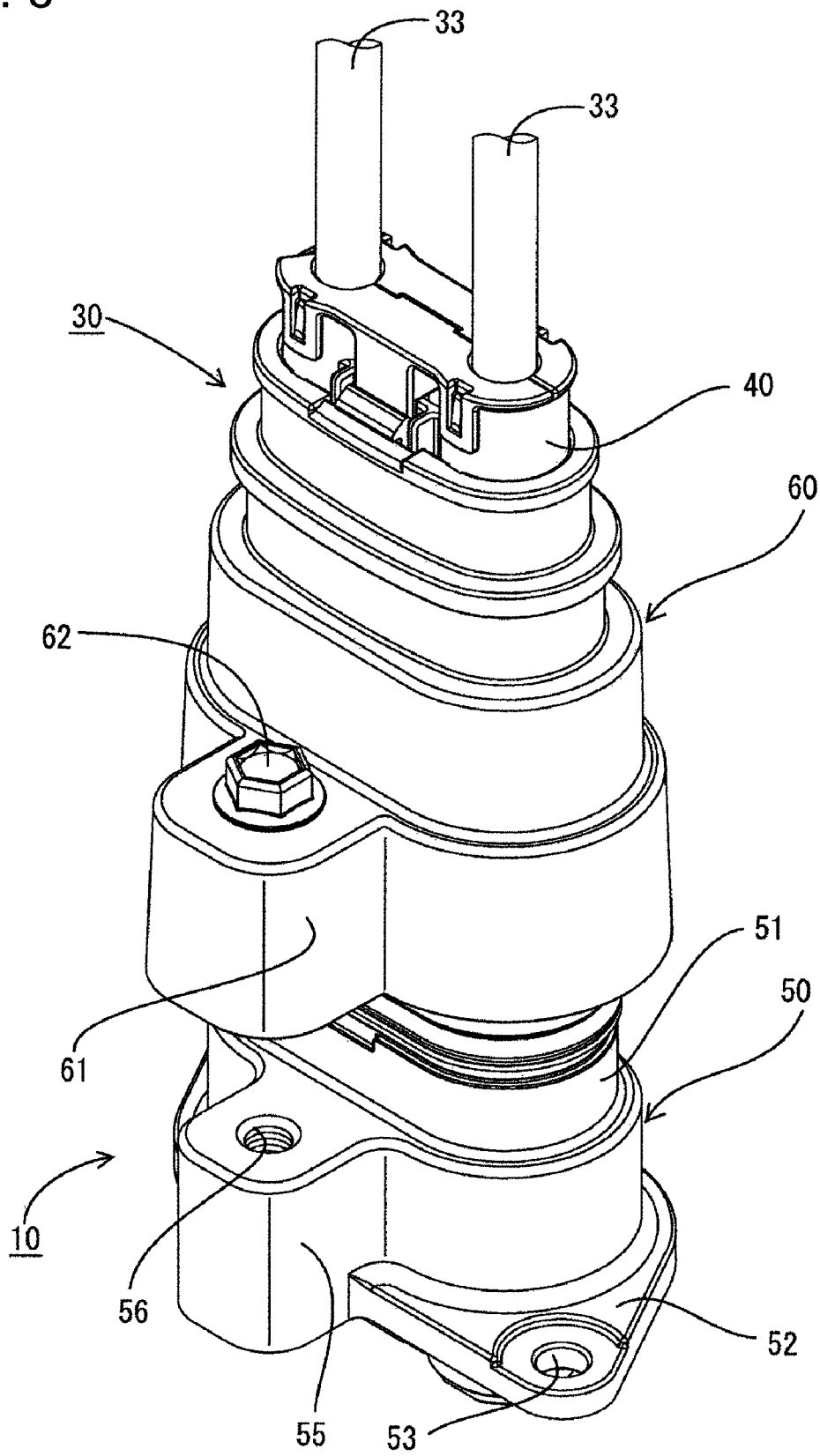
FIG. 6 is a perspective view showing a state before the male and female connectors of the connector apparatus are fitted on each other.

A female screw pedestal 55 projects sideways from the body 51 of the male-side shielding shell 50 in FIG. 6. The female screw pedestal 55 is fit on a fixing part 61 of a female-side shielding shell 60 with the female screw pedestal 55 being enclosed with the fixing part 61 of the female-side shielding shell 60. A threaded hole 56 is formed through the female screw pedestal 55 and can receive a fit-on bolt 62 to be described later. As shown in FIG. 2, a shielding-side rubber ring 57 is mounted on the edge of the periphery of the male body part 51 of the male-side shielding shell 50.

An interlocking accommodation part 17 penetrates longitudinally through the equipment-side connection part 13 of the male connector housing 10A at approximately the middle of a rear end of the equipment-side connection part 13 in its width direction, as shown in FIG. 2. An interlocking connector 18 is inserted into the interlocking accommodation part 17 from the side of the equipment-side connection part 13. An interlocking retainer 19 is mounted on the interlocking connector 18 from the rear for preventing the interlocking connector 18 from being removed from the male housing 10A.

Two laterally spaced plate-shaped guide ribs 14 extend forward from an inner rear wall of the tube 11, as shown in FIG. 2. About the front half of each guide rib 14 projects forward beyond a front end of the tube 11. The guide ribs 14 project forward from side walls of the interlocking accommodation part 17.

Two male terminal fittings 20 are accommodated inside the male housing 10A. Each male terminal fitting 20 has a body 21 and a pin 22 that is unitary and coaxial with the body 21. The body 21 of the male terminal fitting 20 is to be connected to the equipment. The equipment-side connection part 13 is molded around the body 21 of each male terminal fitting 20 and the pin 22 projects inside the tube 11.

The pin 22 has a shaft 23 that extends from the body part 21, a head 24 with a front end that is formed roughly spherically, and a groove 25 between the shaft 23 and head 24. The groove 25 has a diameter smaller than the outer diameters of the shaft 23 and the head 24. The groove 25 is formed on the entire periphery of the head 24. An insulating coating 26 is formed on the peripheral surface of the head 24 and the groove 25. The insulating coating 26 is made of synthetic resin that is molded in a predetermined thickness along the outer configuration of the head 24 and the groove 25.

Figure 3:
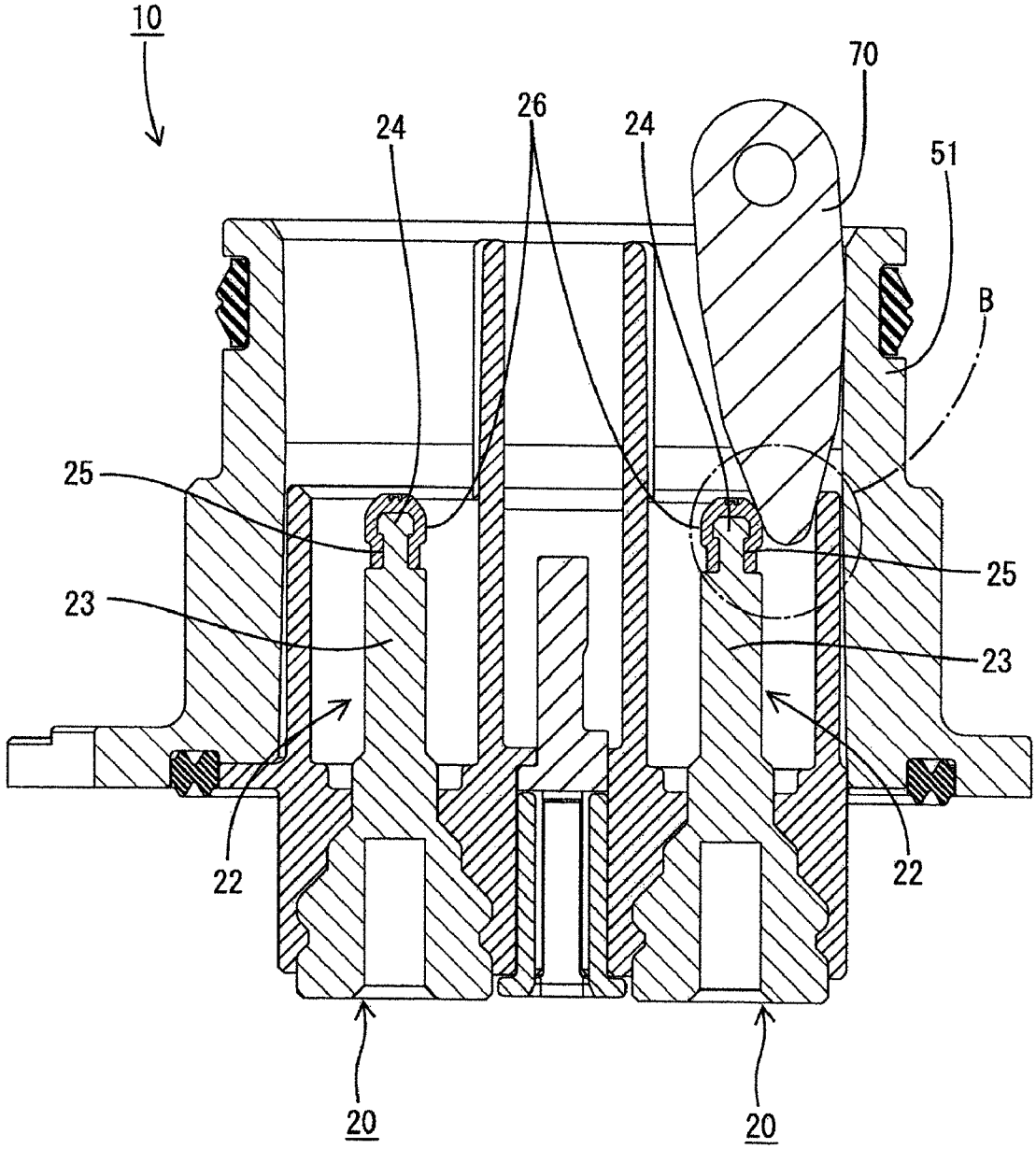
FIG. 3 is a sectional view showing a state in which a test finger is pressed into a gap between a male terminal fitting and a tube of a male connector from a fit-on side.
Figure 4:
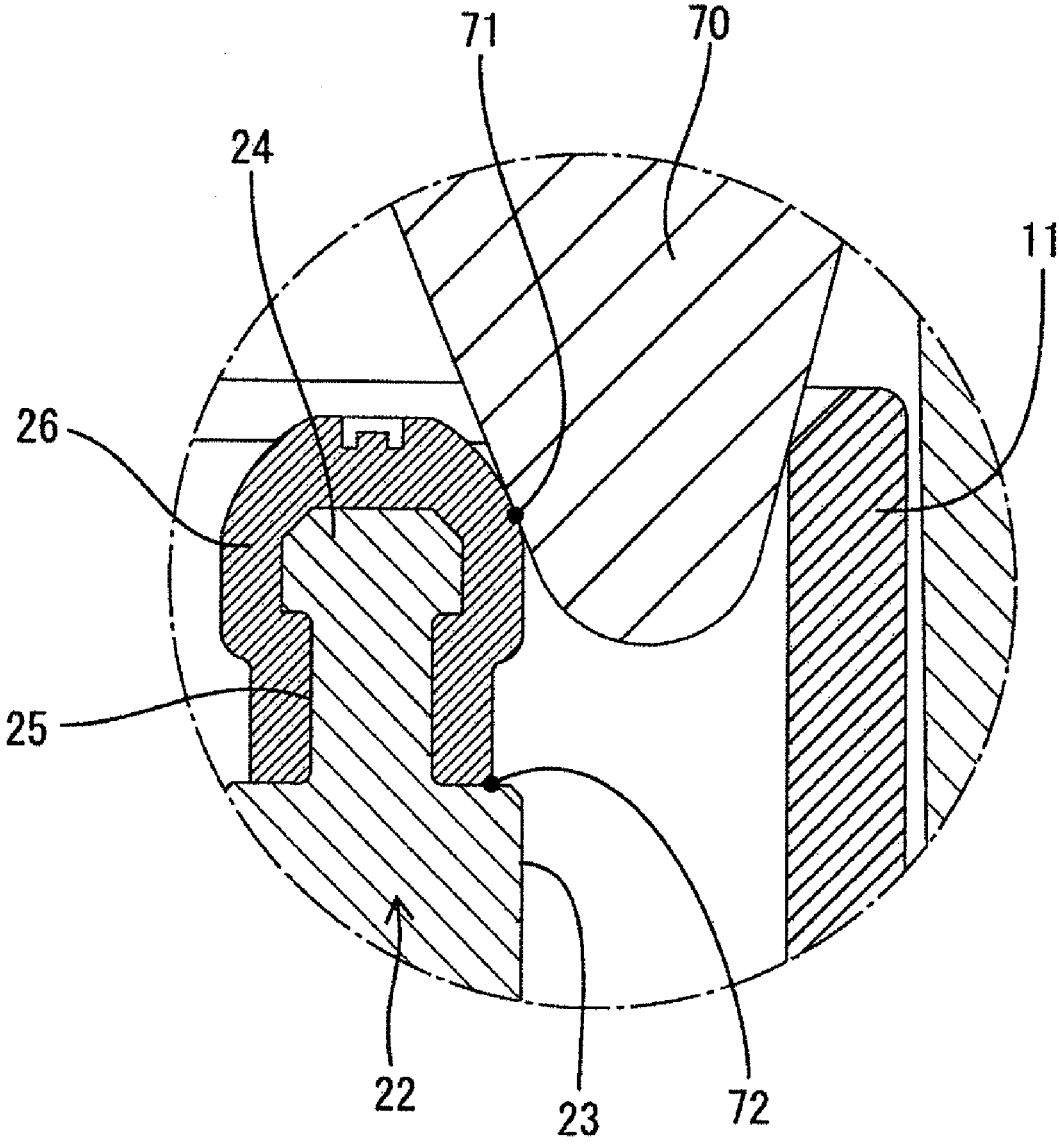
FIG. 4 is an enlarged view of a portion B of FIG. 3.

The thickness of the insulating coating 26 is set so that a test finger 70 cannot contact the shaft 23 when the test finger 70 is pressed into the gap between the pin 22 of the male terminal fitting 20 and the tube 11 of the male housing 10A (see FIGS. 3 and 4).

Figure 5:
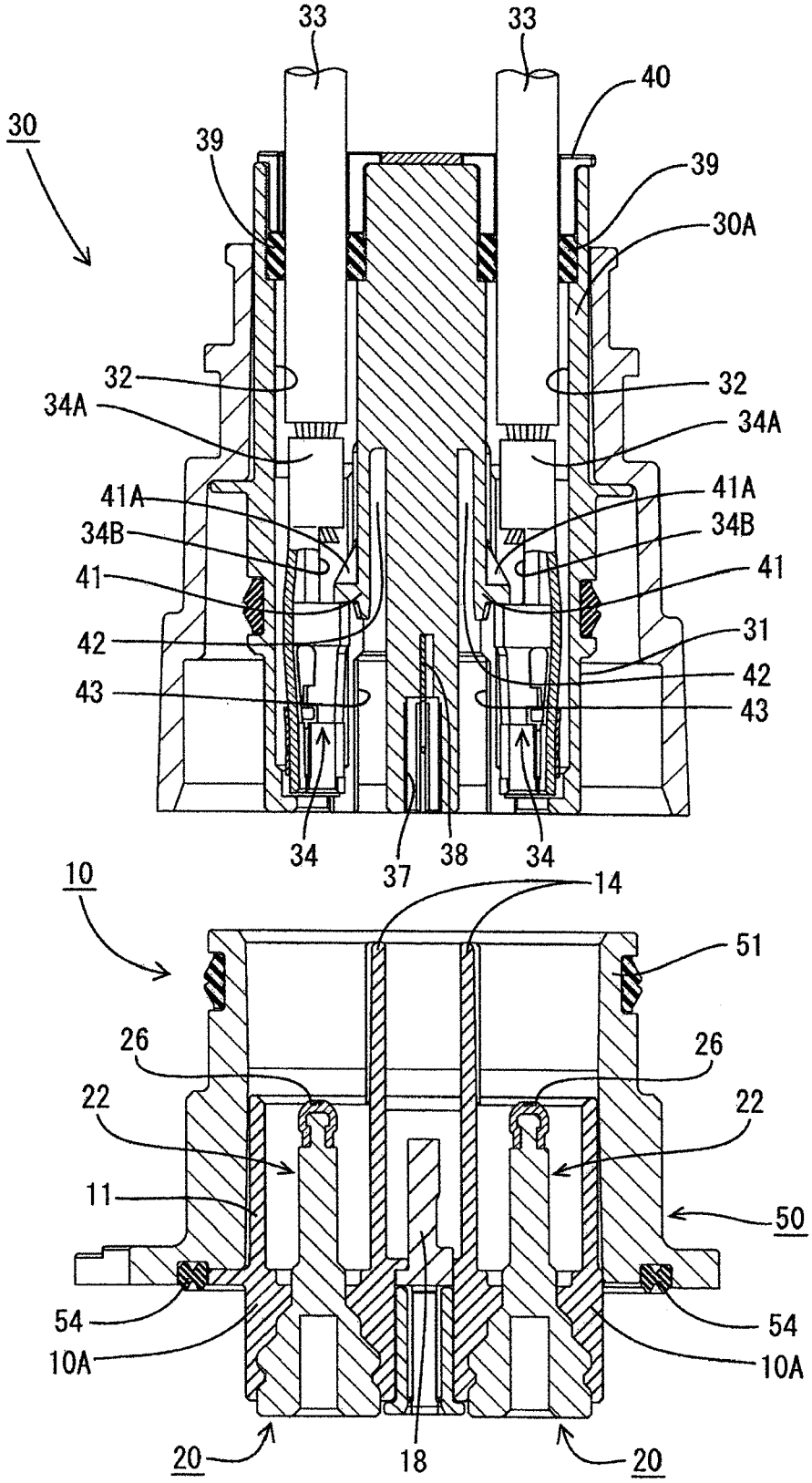
FIG. 5 is a sectional view showing a state before male and female connectors of a connector apparatus of one embodiment of the invention are fit together.

The female connector 30 has a female housing 30A made of synthetic resin and configured to be fit on the male connector 10. The female housing 30A is formed unitarily with two laterally spaced fit-on parts 31 and a cavity 32 extends longitudinally through each fit-in part 31, as shown in FIG. 5. A female terminal fitting 34 connected to an electric wire 33 can be inserted into each cavity 32 from the rear. A sectionally elliptic O-ring accommodation groove 35 extends around the fit-on parts 31 at a longitudinal middle position and a sealing ring 36 is mounted on the O-ring accommodation groove 35.

A square pillar-shaped interlocking fit-on part 37 is provided between the fit-on parts 31 and is spaced from each fit-on part 31. A short-circuit terminal 38 is disposed in the interlocking fit-on part 37 and has two male terminals. The short-circuit terminal 38 fits on the interlocking connector 18 of the male connector 10 to detect whether the female connector 30 and the male connector 10 have been fit together.

A female-side shielding shell 60 made of die-casted aluminum is mounted on the female housing 30A from the rear, as shown in FIGS. 5 and 6. A fixing part 61 protrudes from a side of the female-side shielding shell 60 and fits on the female screw pedestal 55 that projects from a side of the male-side shielding shell 50. A bolt insertion hole is formed on the rear wall of the fixing part 61 and the fit-on bolt 62 is inserted into the bolt insertion hole to fix the female-side shielding shell 60 to the male-side shielding shell 50.

Each female terminal fitting 34 is approximately cylindrical and has opposite front and rear ends. A crimping part 34A is formed at the rear end and a shoulder 34B is formed forward of the crimping part 34A. A rubber stopper 39 is fit on an electric wire 33 and the crimping part 34A is crimped around the stopper 39 and the wire 33. The rubber stopper 39 seals the gap between the electric wire 33 and an inner peripheral surface of the rear half of the fit-on part 31. A back retainer 40 is fit on the electric wire 33 to prevent the rubber stopper 39 from slipping off a rear end of the fit-on part 31.

A lance 41 cantilevers forward in each fit-on part 31 and a locking projection 41A is formed at a front end of the lance 41. The locking projection 41A projects into the cavity 32 and engages the shoulder 34B to prevent the female terminal fitting 34 from being removed from the cavity 32. Each lance 41 is formed on a side of the fit-on part 31 toward the middle and in proximity to the interlocking fit-on part 37. Each lance 41 can flex toward the interlocking fit-on part 37 in the center of the female connector 30.

A flexibility allowance space 42 is formed between each lance 41 and a side surface of the interlocking fit-on part 37 and is dimensioned to allow the lance 41 to deform sufficiently for the locking projection 41A to disengage from the female terminal fitting 34. A guide groove 43 extends continuously into the flexibility allowance space 42 from the front of the female connector 30 and can receive one of the guide ribs of the male connector 10.

The assembly the connector apparatus is described below with reference to FIGS. 5 and 7. Initially, the male-side shielding shell 50 is fit on the male housing 10A and the male connector 10 is mounted on an unshown case by inserting the male connector 10 into the connector-mounting hole formed through the case. The screw insertion hole 53 of the male-side shielding shell 50 and a threaded hole of the case overlap each other and a screw is screwed therein to fix the male-side shielding shell 50 conductively to the case. The rubber packing 54 waterproofs the gap between an outer surface of the case and the male-side shielding shell 50 as well as the male housing 10A.

The female-side shielding shell 60 then is positioned so that the fixing part 61 overlaps the female screw pedestal 55 of the male-side shielding shell 50, as shown in FIG. 6. At this time, the guide rib 14 of the male connector 10 enters the guide groove 43 of the female connector 30. The female connector 30 is considered to be at a temporary fit-on state immediately before the guide rib 14 of the male connector 10 penetrates into the flexibility allowance space 42 of the female connector 30.

The shielding shells 50, 60 then are advanced beyond the temporary fit-on state so that the guide rib 14 moves from the guide groove 43 and into the flexibility allowance space 42. Thus, the female terminal fitting 34 is connected to the male terminal fitting 20. At this time, the lance 41 is engaged with the shoulder 34B of the female terminal fitting 34 and does not project into the flexibility allowance space 42. Thus, the guide rib 14 can penetrate into the flexibility allowance space 42. The sealing ring 36 on the periphery of the female housing 30A closely contacts the inner periphery of the body 51 of the male-side shielding shell 50, thus waterproofing the fit-on surfaces of both housings 10A and 30A.

Figure 7:
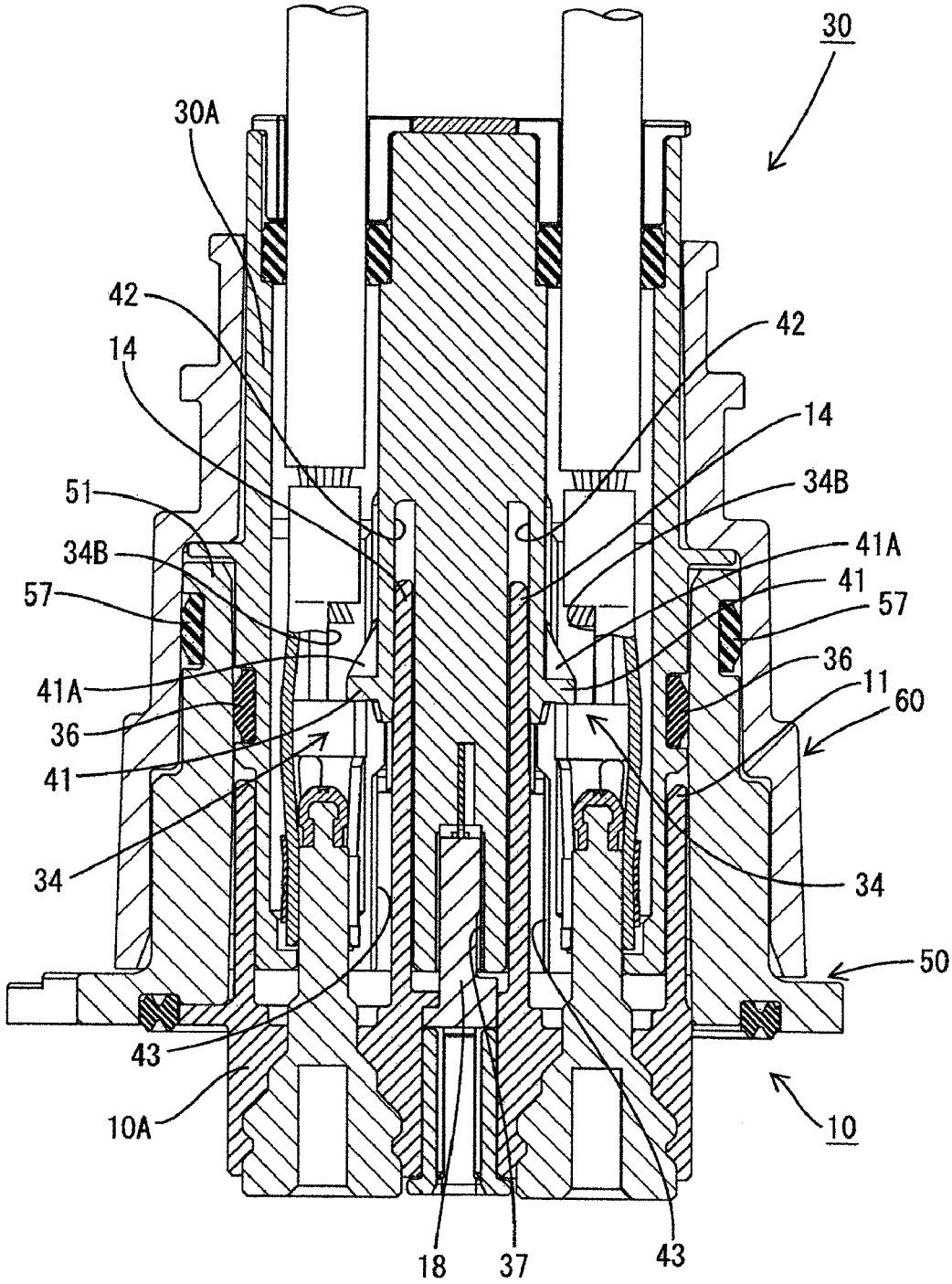
FIG. 7 is a sectional view showing a state after the male and female connectors of the connector apparatus are fitted on each other.

The fit-on bolt 62 fixed to the fixing part 61 then is screwed into the threaded hole 56 formed through the female screw pedestal 55 (see FIG. 6) to obtain a fit-on state, as shown in FIG. 7. At this time, the shielding-side rubber ring 57 mounted on the periphery of the body 51 closely contacts the inner periphery of the female-side shielding shell 60 to waterproof the fit-on surfaces of each of the shielding shells 50 and 60.

The interlocking connector 18 is fit on the interlocking fit-on part 37 when the female connector 30 is fit on the male connector 10. Thus, an unshown fit-on detection circuit detects that the female connector 30 has been fit on the male connector 10. As a result, a relay or the like is closed and a power circuit is energized.

An operator's finger or a test finger 70 can be pressed into the tube 11 when the connectors 10 and 30 are separated from each other, as shown in FIGS. 3 and 4. The front end of the test finger 70 interferes with the insulating coating 26 of the male terminal fitting 20 and the inner wall of the tube 11. As a result, the test finger 70 cannot be pressed to a position where the test finger 70 directly contacts a conductive part of the male terminal fitting 20, such as the shaft 23, exposed to the outside near the rear of the tube 11. Therefore, the operator cannot receive an electrical shock when connectors 10 and 30 are separated from each other because the operator's finger cannot contact the male terminal fitting 20.

As described above, the insulating coating 26 is formed at the front end of the male terminal fitting 20 by molding the synthetic resin. Thus, the operator's finger cannot receive an electrical shock when the connectors 10 and 30 are separated from each other. Further, the convex head 24 and the concave groove 25 are formed at the front of the male terminal fitting 20. Thus, the male terminal fitting 20 has a wide surface area at the front. Therefore the creepage distance along the surface of the insulating coating 26 from a contact point 71 between the male terminal fitting 20 and the test finger 70 pressed into the tube 11 to an end 72 of the shaft part 23 not coated with an insulation film is longer than the creepage distance in the construction where the front of the male terminal fitting is flat.

The insulating coating 26 is formed on the front end of the male terminal fitting 20 by molding the synthetic resin to prevent the operator's finger from receiving the electrical shock. Therefore, the insulating coating 26 is stronger than a case in which an insulator made of synthetic resin is attached to the front end of the male terminal fitting 20. To form the insulating coating 26 by molding the resin does not take much time and labor and improves production efficiency as compared to a construction where the insulator is mounted on the front end of the male terminal fitting 20. Further because the insulating coating 26 is formed by molding the resin, there is no increase in the number of component parts thereby avoiding inventory management problems. Furthermore it is unnecessary to form a portion where the insulator is mounted. Thus the formation of the insulating coating part 26 contributes to miniaturization of the connector.

The thickness of the insulating coating 26 formed on the male terminal fitting 20 by molding the synthetic resin is adjustable in a molding process. Thus the male terminal fitting 20 of one embodiment is more simply and widely applicable than an ordinary male terminal fitting, which necessitates an insulator to be designed according to its configuration. The invention is applicable to a male connector without making major changes, even though its configuration has been already determined and the male connector is not provided with an electrical shock prevention measure. The electrical shock prevention measure of the invention is capable of promptly coping with an alteration of the standard of the insulation distance such as the above-described creepage distance.

The connector of the invention also prevents the lance from flexing in addition to preventing the finger from receiving the electrical shock. More particularly, the lance 41 is locked to the shoulder 34B of the female terminal fitting 34 and holds the female terminal fitting 34 inside the female connector 30 (see FIG. 5, 6). Therefore, the flexibility allowance space 42 exists and is open to the front. The guide rib 14 of the male housing 10 penetrates into the flexibility allowance space 42 as the shielding shells 50 and 60 are fit together. The guide rib 14 is fixed inside the flexibility allowance space 42 when both connectors 10 and 30 are fit together as shown in FIG. 7, thus preventing the lance 41 from flexing. Therefore the female terminal fitting 34 is locked doubly to the female housing 30A and is held at a high strength.

The lance 41 will not be in a normal locking state if the female terminal fitting 34 is not inserted sufficiently into the cavity. Thus, the lance 41 will project into the flexibility allowance space 42. The guide rib 14 will contact the part of the lance 41 in the flexibility allowance space 42 in the process of fitting the female connector 30 and the male connector 10 together. Therefore, the male and female connectors 10 and 30 cannot be fit together completely and it is possible to immediately detect that the female terminal fitting 34 is in a locking-inadequate state.

The guide rib 14 is unitary with the male housing 10A to prevent an increase in the number of component parts and to make the connector compact. A conventional connector has a retainer that is separate from the housing and the female connector must have a locking mechanism for holding the retainer. However the guide rib 14 of the invention is unitary with the male housing 10A. Thus, the female connector 30 does not need a locking mechanism that would require additional space between the interlocking fit-on part 37 and the cavity 32 and hence the connector can be compact.

The invention is not limited to the embodiments described above with reference to the drawings. For example, the following embodiments are also included in the technical scope of the present invention.

In the above-described embodiment, the groove 25 is formed on the male terminal fitting 20, and the insulating coating 26 is formed along the groove 24 by molding the resin. However the groove 25 need not be formed not on the male terminal fitting 20 and can be on the periphery of the insulating coating 26. Thus, the groove 25 can be formed irrespective of the configuration of the front end of the male terminal fitting 20 and it is possible to secure a long insulation distance such as the creepage distance In the above-described embodiment, the male terminal fitting 20 is approximately cylindrical. However, the male terminal fitting 20 may be flat.

What is claimed is:

1. A male connector comprising:

a male housing having at least one forwardly open tube;

a male terminal fitting mounted in the male housing, the male terminal fitting having a pin projecting into the tube, the pin being spaced in from the tube by a distance selected to prevent inserting a finger between the tube and the pin, the pin having a front end in the tube, a head adjacent the front end and having a first diameter, a groove rearward of and adjacent to the head and having a second diameter less than the first diameter and a shaft rearward of and adjacent to the groove and having a third diameter greater than the second diameter; and an insulating coating molded on the front end of the pin, the insulating coating covering the head and filling the groove so that the portion of the insulating coating in the groove prevents separation of the insulating coating from the head.

2. The connector of claim 1, wherein the groove has a surface facing rearward, the insulating coating engaging the surface of the groove facing rearward for securely retaining the insulation coating on the male terminal fitting.

3. The connector of claim 1, wherein the third diameter is greater than the first diameter.

4. The connector of claim 1, wherein the shaft is rearward of the insulation coating.

5. The connector of claim 1, wherein the at least one tube comprises two tubes and a guide rib between the tubes.

6. A connector apparatus comprising:

a male connector having a male housing with two forwardly open tubes and at least one guide rib between the tubes, male terminal fittings mounted in the male housing, the male terminal fittings having pins projecting respectively into the tubes, the pins being spaced in from the respective tubes by a distance selected to prevent inserting a finger between either of the tubes and the respective pin, each of the pins having a front end in the tube, a head adjacent the front end and having a first diameter, a groove rearward of and adjacent to the head and having a second diameter less than the first diameter and a shaft rearward of and adjacent to the groove and having a third diameter greater than the second diameter, and an insulating coating molded on a front end of each of the pins, the insulating coating covering the head and filling the groove so that the portion of the insulating coating in the groove prevents separation of the insulating coating from the head; and a female connector to be fit on said male connector, the female connector having a female housing with two fit-in parts formed respectively with cavities and female terminal fittings mounted respectively in the cavities of the fit-in parts, a lance disposed in each of the fit-on part and configured for locking the female terminal fittings in the respective cavity, the lance being elastically deformable into a flexibility allowance space for unlocking the female terminal fitting, wherein and the guide rib of the male connector penetrates into the flexibility allowance space of the female connector when the male and female connectors are fit together thus preventing the lance from elastically deforming.

7. The connector apparatus of claim 6, wherein the third diameter is greater than the first diameter.

8. The connector apparatus of claim 6, wherein the groove has a surface facing rearward, the insulating coating engaging the surface of the groove facing rearward for securely retaining the insulation coating on the male terminal fitting.

9. The connector apparatus of claim 8, wherein the shaft is rearward of the insulation coating.

* * * * *